US007227501B2

(12) United States Patent
Lange

(10) Patent No.: US 7,227,501 B2
(45) Date of Patent: Jun. 5, 2007

(54) COMPENSATING STRUCTURES AND REFLECTOR ANTENNA SYSTEMS EMPLOYING THE SAME

(75) Inventor: Mark J. Lange, Malibu, CA (US)

(73) Assignee: The Aerospace Corporation, El Segundo, CA (US)

( * ) Notice: Subject to any disclaimer, the term of this patent is extended or adjusted under 35 U.S.C. 154(b) by 175 days.

(21) Appl. No.: 10/979,942

(22) Filed: Nov. 2, 2004

(65) Prior Publication Data

US 2006/0092087 A1 May 4, 2006

(51) Int. Cl.
*H01Q 1/38* (2006.01)
*H01Q 15/02* (2006.01)

(52) U.S. Cl. ..... 343/700 MS; 343/781 R; 343/909

(58) Field of Classification Search ..... 343/781 P, 343/781 CA, 700 MS, 756, 909, 781 R
See application file for complete search history.

(56) References Cited

U.S. PATENT DOCUMENTS

| | | | | |
|---|---|---|---|---|
| 3,231,892 | A | 1/1966 | Matson et al. | |
| 4,905,014 | A | 2/1990 | Gonzalez et al. | |
| 5,103,241 | A * | 4/1992 | Wu | 343/909 |
| 5,812,096 | A | 9/1998 | Tilford | |
| 6,081,234 | A * | 6/2000 | Huang et al. | 343/700 MS |
| 6,392,611 | B1 * | 5/2002 | Smith et al. | 343/912 |
| 6,396,451 | B1 * | 5/2002 | Wu et al. | 343/756 |
| 6,473,057 | B2 * | 10/2002 | Monzon | 343/909 |
| 6,512,485 | B2 | 1/2003 | Luly et al. | |
| 6,768,468 | B2 | 7/2004 | Crouch et al. | |

* cited by examiner

*Primary Examiner*—Tan Ho
(74) *Attorney, Agent, or Firm*—Henricks, Slavin & Holmes LLP

(57) ABSTRACT

A compensating structure includes layers of non-uniform arrays of conductive patches configured to provide phase and/or amplitude distribution modification of feed primary patterns.

56 Claims, 16 Drawing Sheets

TRANSMISSIVE DIFFERENTIAL PHASE AND AMPLITUDE COMPENSATING STRUCTURE ANTENNA SYSTEM

TRANSMISSIVE DIFFERENTIAL PHASE AND AMPLITUDE COMPENSATING STRUCTURE

TRANSMISSIVE DIFFERENTIAL PHASE AND AMPLITUDE COMPENSATING STRUCTURE ANTENNA SYSTEM

TRANSMISSIVE DIFFERENTIAL PHASE AND AMPLITUDE COMPENSATING STRUCTURE

CONDUCTOR DENSITY

TRANSMISSION PHASE DELAY AND OPTIMUM LAYER SEPARATION vs. CONDUCTOR DENSITY

FREQUENCY RESPONSE OF ONE AND TWO LAYER GRID ASSEMBLY

COLLIMATING AND COMPENSATING GRID LAYER

SQUINTING GRID LAYER

DE-SQUINTING GRID LAYER

SECTORING GRID LAYER

REFLECTIVE AND TRANSMISSIVE DIFFERENTIAL PHASE AND AMPLITUDE COMPENSATING DUAL FREQUENCY ANTENNA SYSTEM

RELECTIVE AND TRANSMISSIVE DIFFERENTIAL PHASE AND AMPLITUDE COMPENSATING STRUCTURE

REFLECTIVE AND TRANSMISSIVE DIFFERENTIAL PHASE AND AMPLITUDE COMPENSATING STRUCTURE

RELECTIVE DIFFERENTIAL PHASE COMPENSATING
DUAL FREQUENCY ANTENNA SYSTEM

REFLECTIVE DIFFERENTIAL PHASE COMPENSATING STRUCTURE

TRANSMISSIVE DIFFERENTIAL AMPLITUDE
COMPENSATING ANTENNA SYSTEM

TRANSMISSIVE DIFFERENTIAL AMPLITUDE COMPENSATING STRUCTURE

COMPENSATING STRUCTURES AND REFLECTOR ANTENNA SYSTEMS EMPLOYING THE SAME

STATEMENT OF GOVERNMENT INTEREST

The invention was made with Government support under contract No. F04701-00-C-0009 by the Department of the Air Force. The Government has certain rights in the invention.

TECHNICAL FIELD

The invention relates generally to communication systems and, in particular, to multi band satellite or earth station antennas with coincident or multiple beams.

BACKGROUND ART

Satellite based communication systems provide an outstanding solution for the delivery of video to the consumer. However, to remain competitive with alternative delivery methods, such as cable and digital subscriber line, the satellite systems must provide a greater variety and quantity of content. Additionally, the introduction and migration to high definition television consumes larger amounts of the available spectrum. Thus, there is a continuously increasing requirement for greater bandwidth in satellite systems.

Initially, direct broadcast satellite systems operated in the Ku band, and received signals from a single satellite in geosynchronous orbit with a reflector less than one half meter in diameter. Increasing the capacity of such systems was achieved with multiple beams receiving signals from two or three satellites in geosynchronous orbits with 9 degree spacing. The reflector size was only slightly increased to compensate for the loss in gain on the offset beams.

To further increase capacity of such systems it is necessary to make use of satellites operating at Ka band with 2 degree orbital spacing. The antennas must be capable of receiving multiple beams in multiple bands while remaining less than 1 meter in diameter. However, the narrow beam angle of the ka band satellites forces the antenna feeds to be separated from each other by a distance that is proportional to the tangent of the beam angle and the reflector size. As a consequence, the antenna must be much greater than one meter in diameter to allow the feeds to be properly spaced such that the resulting beams are separated by two-degree angles. Large antennas are acceptable for some commercial operations; however they are unacceptable for consumer applications (e.g., where home owners associations limit the antenna dimensions to less than one meter).

It would be useful to be able to address the above deficiencies and to provide a small, multi-beam, multi-band reflector antenna with high efficiency and narrow beam separation.

DISCLOSURE OF INVENTION

In an example embodiment, a reflector antenna system includes (or is provided with) one or more differential gain compensating structures formed from multiple layers of non-uniform arrays of conductive patches providing phase and amplitude distribution modification of feed primary patterns. For purposes of the present description, the term "non-uniform array" means an array with conductive patches that are not equidistantly spaced and/or that are not equal in size. The non-uniform arrays of conductive patches provide a differential phase delay proportional to the conductor density and are arranged in layer pairs to minimize the reflection coefficient of the pairs. By way of example, the compensating structures function as lossless lenses to collimate, squint, de-squint, sector and compensate the primary radiation pattern, resulting in improved efficiency and interference rejection by modifying the secondary beam pointing angle, side lobe level and null locations in multiple beam, multiple band antennas.

In various embodiments, differential gain compensating structures according to the present invention serve to position multiple feeds, operating in different frequency bands, in convenient locations around the focus of a (small) reflector while achieving beam-pointing angles that are different than would occur from positioning the feeds without the differential gain compensating structures.

In various embodiments, a system or mechanism for changing the beam pointing angles of a multi-beam antenna is provided. In various embodiments, a system or mechanism for modifying the phase and amplitude of one feed in a different way than that of a second feed is provided. In various embodiments, a system or mechanism for increasing the illumination and spillover efficiency of an antenna system is provided. In various embodiments, a system or mechanism for improving the interference rejection from adjacent satellites or terrestrial sources by judicious placement of nulls or control of side lobe levels is provided. In various embodiments, a system or mechanism for producing coincident beams where multiple feed locations would otherwise preclude the coincident pointing angles is provided. In various embodiments, a system or mechanism for retrofitting additional feeds to an existing antenna system with physical constraints that preclude the desired beam pointing angles is provided.

Figure 1A:
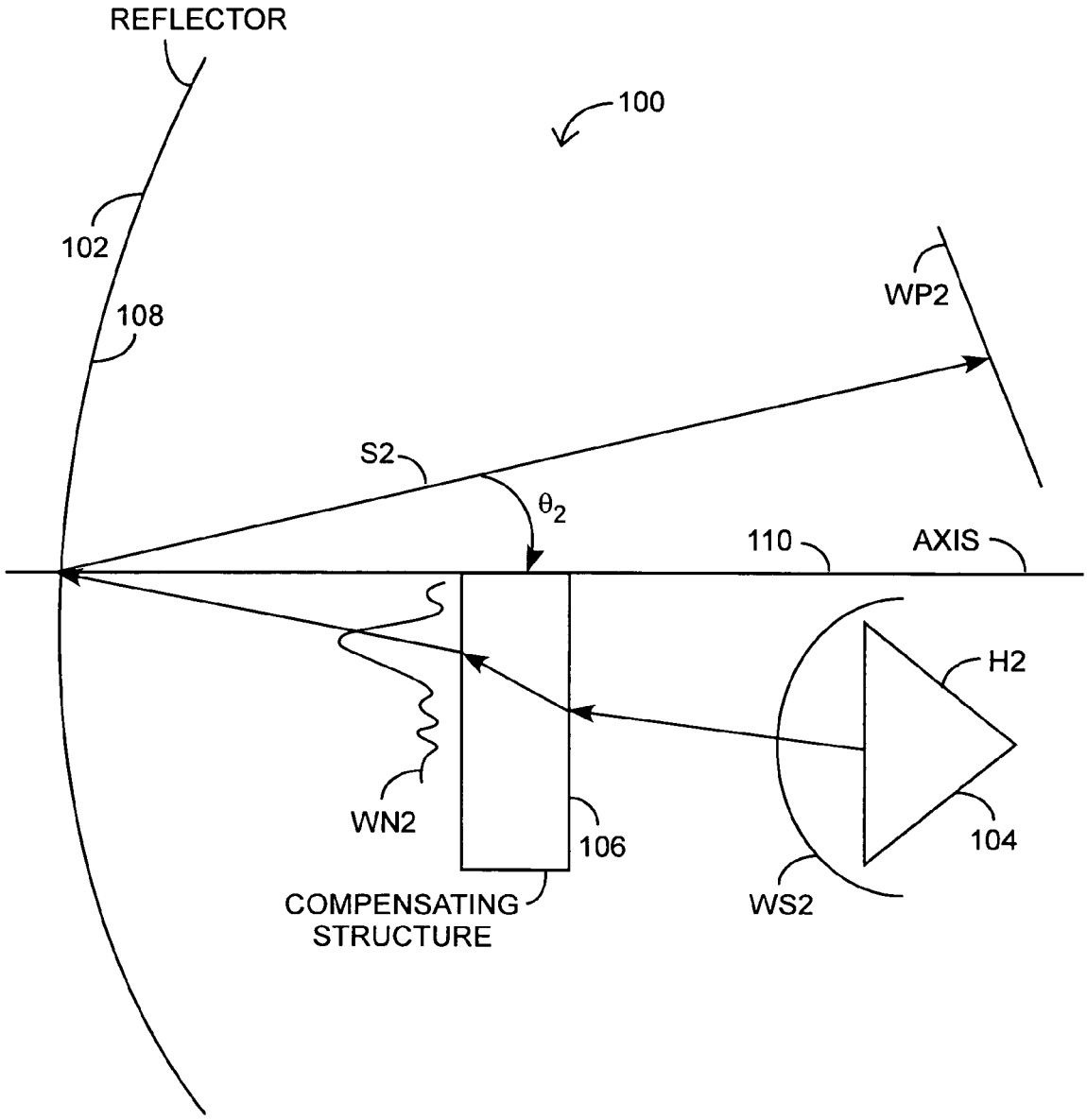
FIG. 1A illustrates an antenna system including a transmissive differential phase and amplitude compensating structure according to an example embodiment of the present invention.

Referring to FIG. 1A, according to an example embodiment, an antenna system 100 includes a reflector 102, a feed 104 (H2) and a transmissive differential phase and amplitude compensating structure 106 configured as shown. Signal S2 is communicated from the feed 104 (H2) through the compensating structure 106 where the signal is squinted inward towards the axis of the antenna and then squinted back out towards the center of the reflector 102, where it is then reflected off the reflector surface 108 at an angle $\theta_2$ with respect to the antenna axis 110. The angle $\theta_2$ is less than that which would be achievable without the compensating structure 106.

Figure 1B:
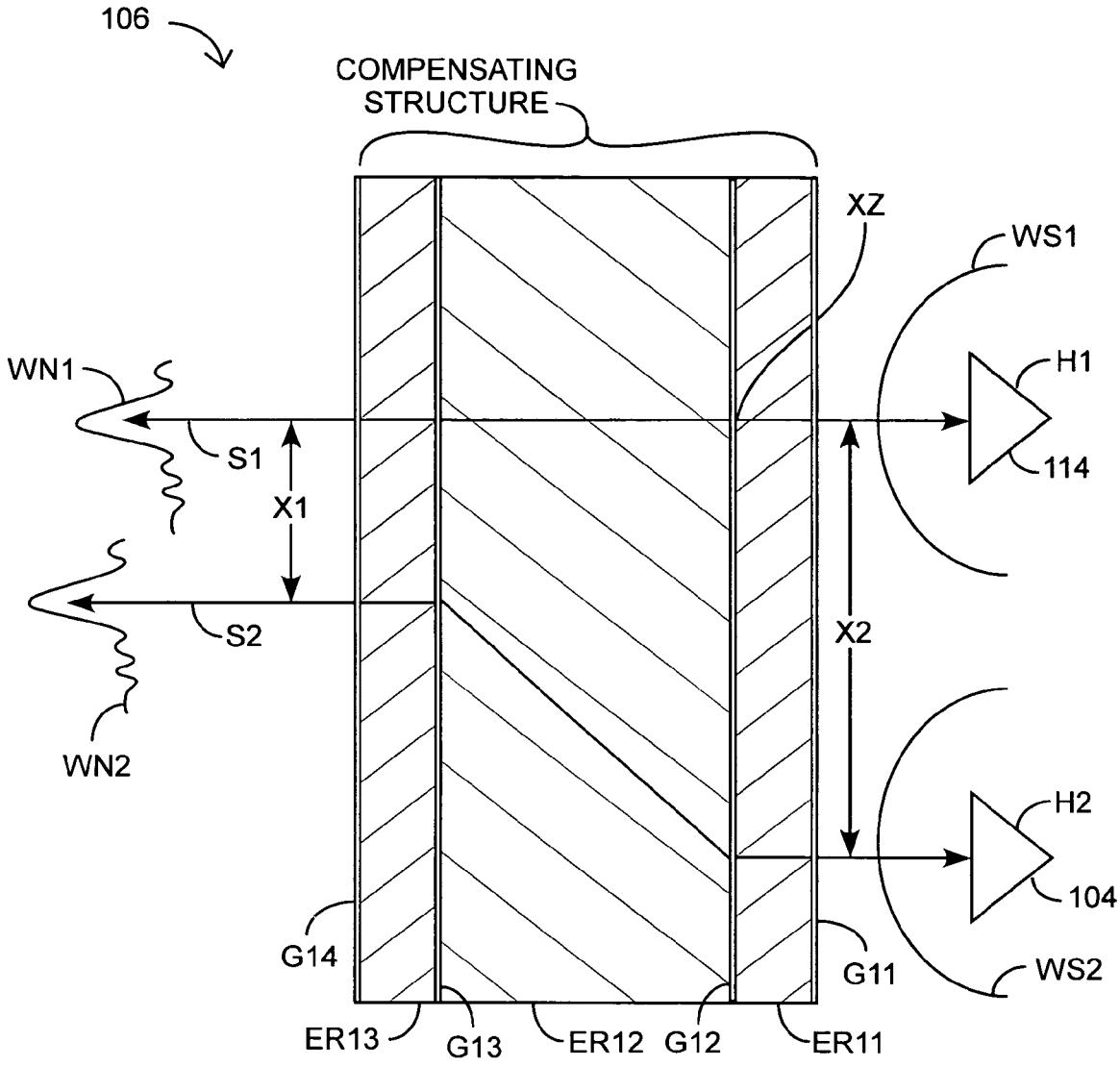
FIG. 1B is a cross-sectional view of the transmissive differential phase and amplitude compensating structure of FIG. 1A.
Figure 1C:
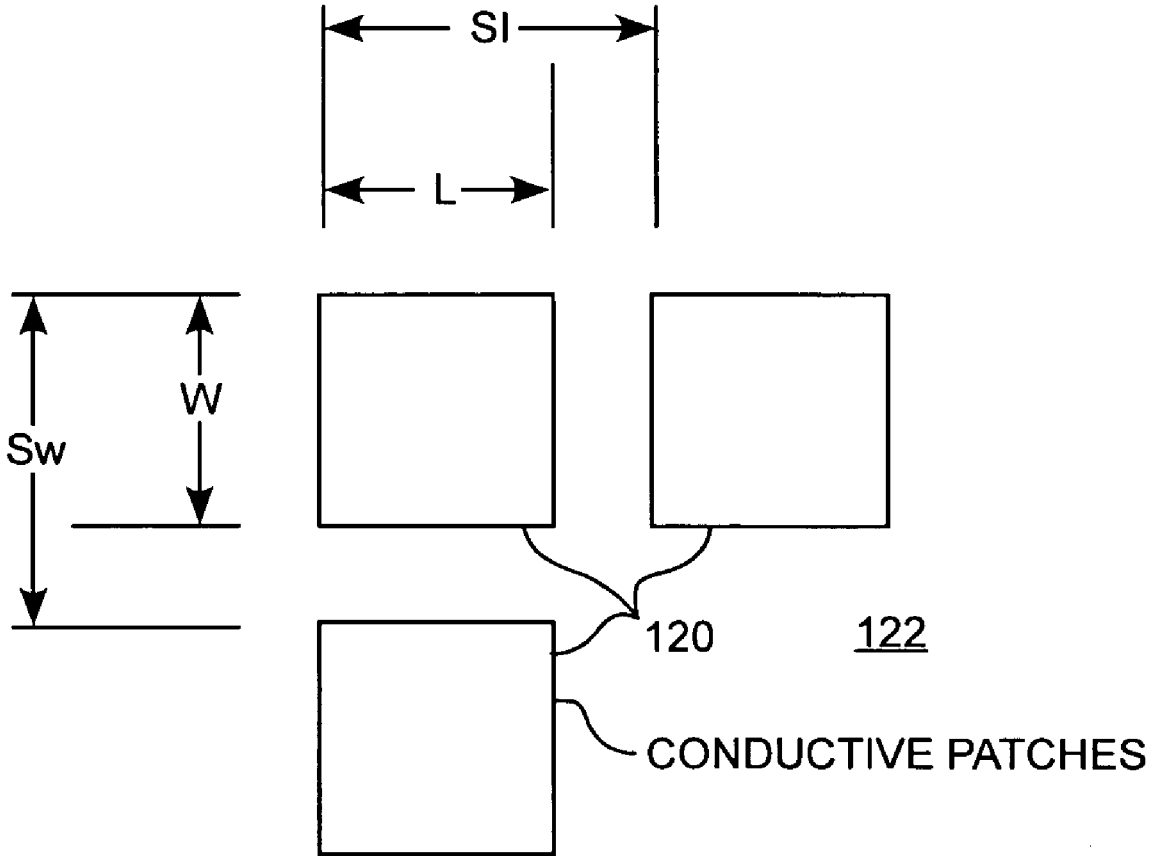
FIG. 1C illustrates the relationship between conductor density and dimensions for the grid conductors.

Referring to FIGS. 1B and 1C, in this example embodiment, the compensating structure 106 includes multiple layers of non-uniform arrays of conductive patches G11, G12, G13 and G14 configured as shown. In this example embodiment, the layers are paired such that G11 and G12 form one layer pair and layers G13 and G14 form a second layer pair. In this example embodiment, the layers are separated by low dielectric constant foam, ER11 and ER13, with a distance that is a quarter of the effective wavelength or less, such that each layer pair produces a very small reflection coefficient. Unrelated pairs are spaced much greater than a quarter wavelength, by a similar low dielectric constant foam, ER12, and do not significantly interact with each other. The low dielectric constant foam is, for example, Polystyrene or Polyimide foam with a density of between 2 pounds per cubic foot to 12 pounds per cubic foot.

Referring to FIG. 1B, signal S1 is communicated from feed 114 (H1), which is located on the axis of the reflector antenna, through the compensating structure 106, and is reflected off the reflector surface along the reflector axis. The compensating structure 106 shapes the primary radiation pattern from H1 without squinting the signal S1.

The phase and amplitude distribution of the respective signals are modified by the compensating structure 106 such that the spherical phase fronts, WS1 and WS2, surrounding feeds H1 and H2, respectively, and centered along the axis and at X2 from the axis, respectively, having cos(x−x2) amplitude distributions, are transposed into sin(x−x1)/(x−x1) or other non-linear phase and amplitude distribution at the far side of the compensating structure where, X1<X2.

The reactive near field distribution at the surface of the compensating structure 106 transforms to the radiating near field or far field in propagating towards the surface of the reflector, into a second spherical phase front, with a sector of uniform amplitude distribution across the aperture of the reflector. This sector pattern rolls off rapidly before reaching the edge of the reflector such that the secondary radiation pattern side lobes are minimized and the spillover energy is also minimized. In this example, the reflector surface is substantially parabolic or shaped to specifically eliminate any residual phase errors across the reflector surface, essentially converting the transformed non-linear waves into the desired plane waves, WP1 (not shown) and WP2 (FIG. 1A), radiating at the desired beam pointing angle $\theta_2$ with respect to the axis 110 of the antenna. The entire system described above is passive and reciprocal, and as such, the same discussion holds true for both transmitting and receiving modes of the signals S1 and S2.

Referring to FIG. 1C, the arrays are formed from conductive patches 120 on a supporting film 122 with dimensions that are functions of position x, y and z, with a width W (x,y,z) and length L (x,y,z), where W and L are less than a quarter wavelength across, and are arrayed with center to center conductor spacing of SW (x,y,z) and SL (x,y,z). The conductor density is related to the patch dimensions and patch spacing by $$\text{Density}(x,y,z)=(L(x,y,z)*W(x,y,z))/(SL(x,y,z)*SW(x,y,z))$$

For densities approaching 100%, the patches 120 alternate on both sides of the supporting film 122, such that there is always a gap between adjacent patches 120 of no less than the thickness of the supporting film 122. At 100% density, the conductor pattern is a self-complementary structure on each side of the film 122, with the conductor pattern on the top-side, being offset from the pattern on the bottom side by the width of the patch in two dimensions.

Figure 1D:
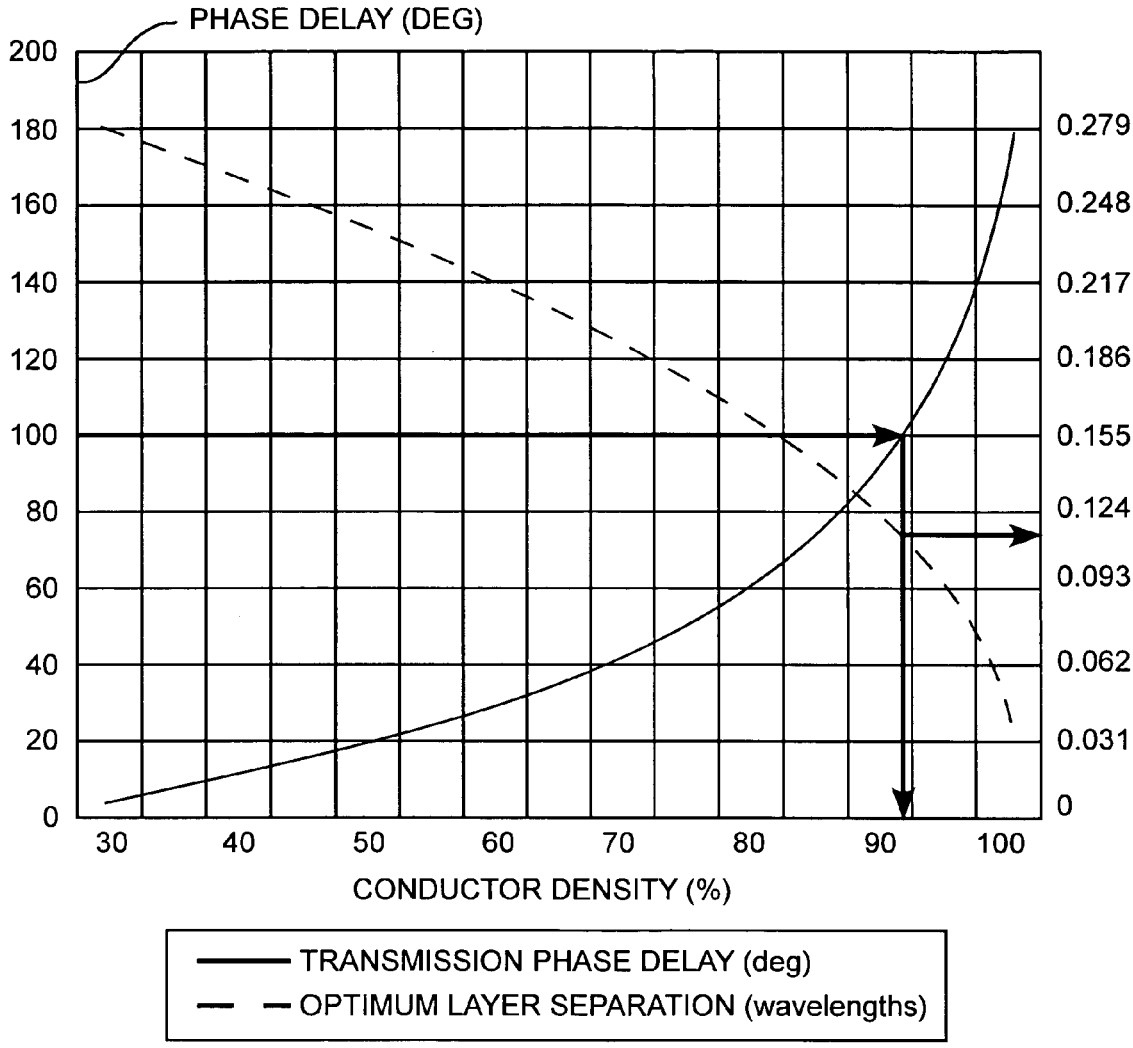
FIG. 1D is a plot of transmission phase delay and optimum layer separation vs. conductor density.

Referring to FIG. 1D, the desired transmission phase delay can be selected to obtain the optimum layer separation and conductor density. For example, to obtain a phase delay of 100 degrees, we enter the chart from the left side at the 100 degree line, moving across until intersecting the phase curve. At this point we move up or down the chart until intersecting the optimum separation curve. The ideal layer separation in free space wavelengths is then found on the right side of the chart at 0.095 wavelengths. Continuing down to the bottom of the chart we identify the required conductor density at 90%. Computation of the patch dimensions and spacing are then performed using the equation above.

Figure 1E:
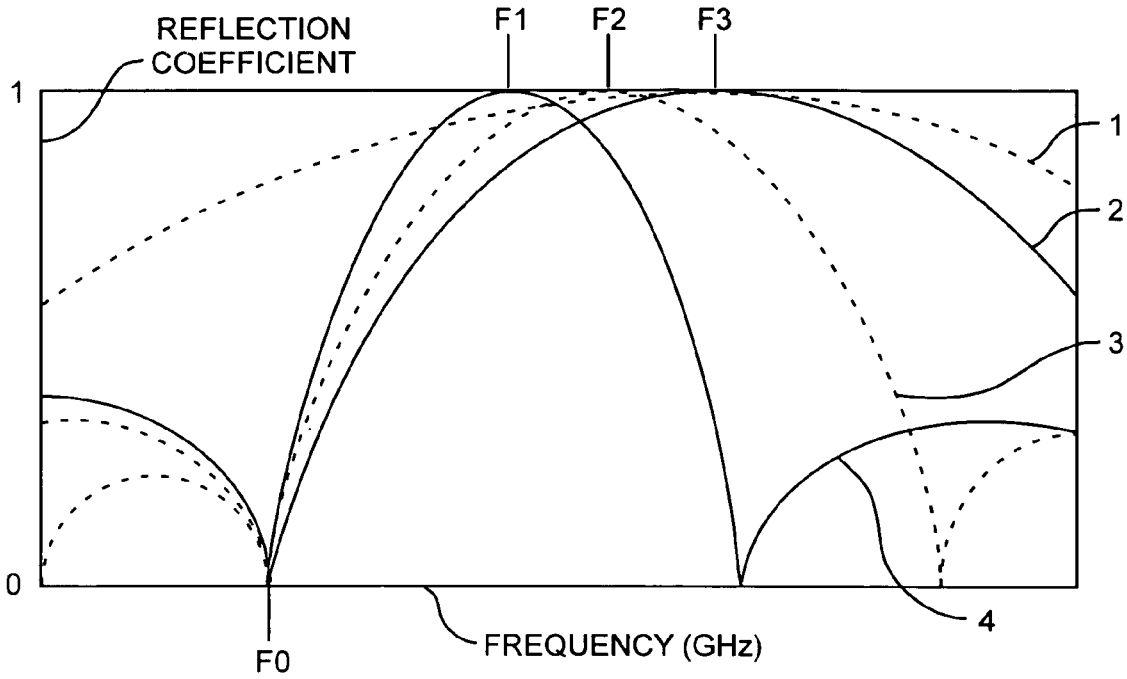
FIG. 1E is a plot of the transmission coefficient vs. frequency for grid pairs with different conductor density and layer separation.

Referring to FIG. 1E, the reflection coefficient versus frequency is shown for four different conductive layers with differing conductor densities. Trace 1 shows the frequency response for a single layer conductive array with resonant frequency at F3. The reflection coefficient rolls off very slowly as the operating frequency moves away from resonance. Trace 2 is a plot of a two-layer array with resonant frequency also at F3. The frequency response of the two-layer array rolls off much faster than the single layer array of comparable conductor density. In this case the conductor density and layer spacing are set such that the null below resonance occurs at frequency F0. Trace 3 is a plot of a two-layer array with resonant frequency now at F2, where F2 is at a frequency lower than F3. However the conductor density and layer spacing is set such that the null below resonance remains at frequency F0. Trace 4 results from an array pair with conductor density and layer spacing set to provide a resonant frequency at F1 and a null at frequency F0. F1 occurs at a frequency lower than F2. The differences found in plots 2, 3 and 4 are a result of the increasing conductor density producing a more rapid roll off of the reflection coefficient with frequency. It should be noted that the frequency of the null at F0 is inversely proportional to the layer separation. Thus by properly selecting the conductor density and layer separation, the compensating structure 106 can provide different amounts of transmission phase delay while simultaneously providing a low reflection coefficient. It can be seen that the transmission phase delay through each layer is inversely proportional to the difference in frequency between F0 and F1, or F0 and F2, or F0 and F3. Thus a high conductor density produces a rapid roll off from F1 to F0, and an associated large phase delay compared to the layers with low conductor density and slow roll off between F3 and F0. Adjusting the layer spacing maintains the low reflection coefficient at F0 in the operating band.

FIGS. 1F–1J illustrate example conductive array layers that produce different functions based on the principles discussed above. In various embodiments, each layer performs a different function. In various embodiments, several functions can be combined into a single layer. By way of example, the functions of the individual layers include collimating, squinting, de-squinting, sectoring and compensating of the primary radiation patterns of multiple feeds.

Figure 1F:
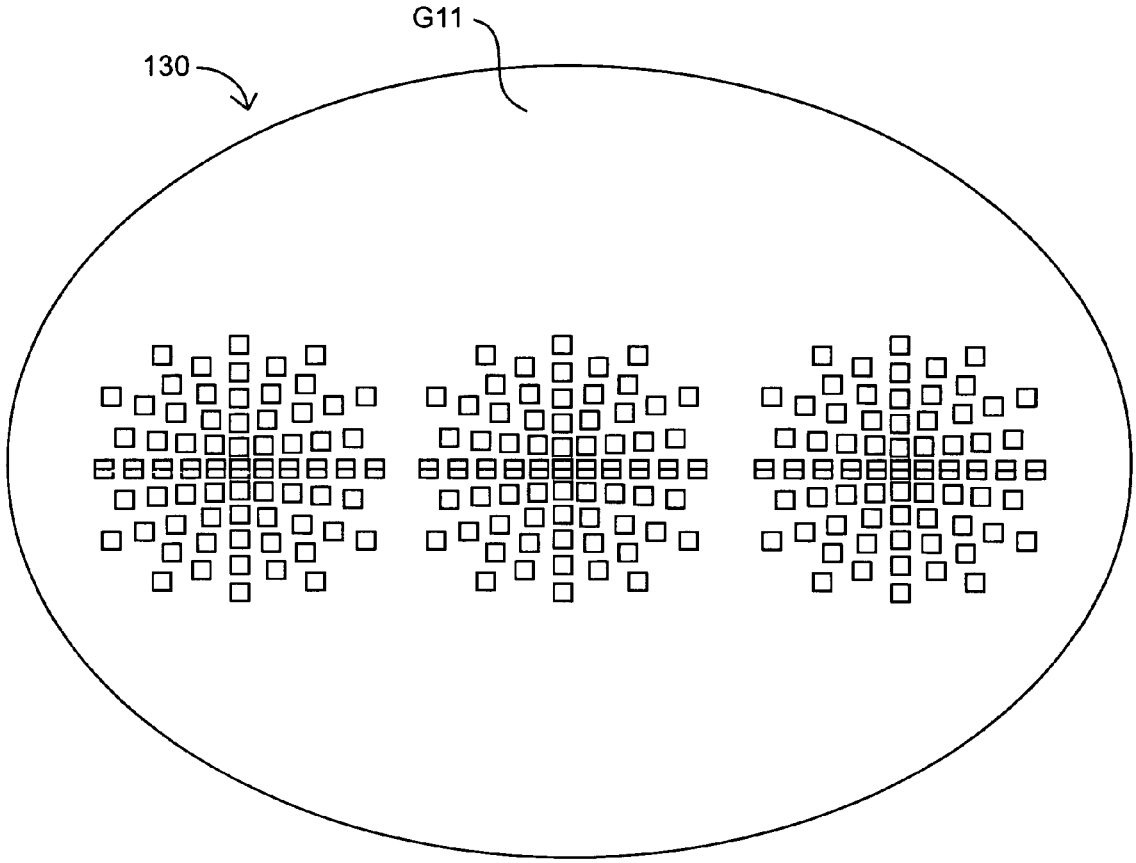
FIG. 1F shows an example embodiment of a collimating and compensating grid layer that can be used in the transmissive differential phase and amplitude compensating structure of FIG. 1A.

Referring to FIG. 1F, in an example embodiment, a collimating and compensating array layer 130 (G11) is configured with conductive patches as shown to narrow the radiation pattern coming from the feeds, H1 and H2. The patch array pattern shown in FIG. 1F provides a collimating lens effect for three separate feeds. The conductor density is greatest at the center of the feed axis and decreases radially outward from the feed axis. This allows a transformation of a concave spherical phase front to a planar or convex phase front at the near field region adjacent to the feeds. The phase distribution and resulting radiation pattern of each feed can be modified independently when the array layer 130 is located closest to the feeds.

Figure 1G:
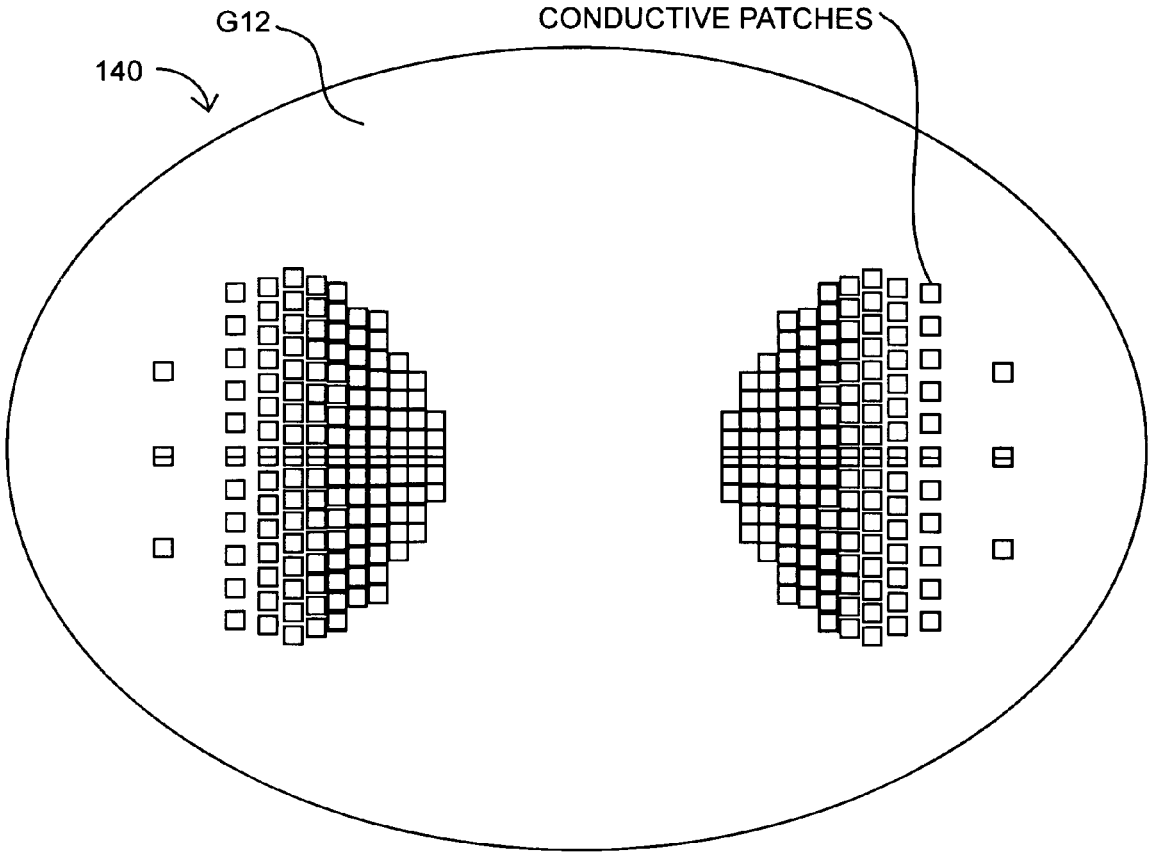
FIG. 1G shows an example embodiment of a squinting grid layer that can be used in the transmissive differential phase and amplitude compensating structure of FIG. 1A.

FIG. 1G shows an example embodiment of a squinting array layer 140 (G12) configured with conductive patches as shown to squint the beam from the feed in one direction ranging from several degrees up to about 20 degrees. In this example embodiment, the density of the patch array varies such that a phase progression of 120 degrees per wavelength is achieved across the aperture of the feed. This produces a beam squint of 20 degrees for the primary radiation pattern from the feed. The layer G12 squints the outer feed patterns in towards the axis of the antenna for feed H2 and its mirror image on the opposite side of the antenna axis, but does not impact the pattern from feed H1.

Figure 1H:
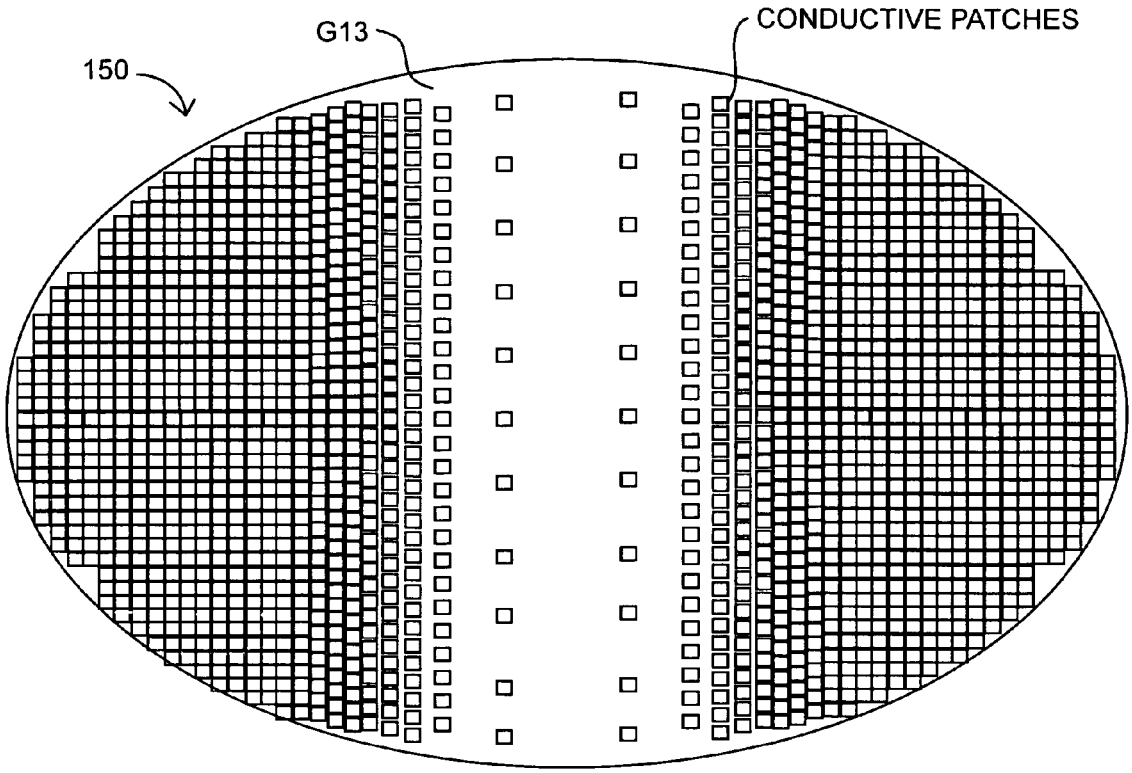
FIG. 1H shows an example embodiment of a de-squinting grid layer that can be used in the transmissive differential phase and amplitude compensating structure of FIG. 1A.

FIG. 1H shows an example embodiment of a de-squinting array layer 150 (G13) configured with conductive patches as shown. The de-squinting array layer G13 is similar to the squinting grid G12, except that the conductive patches are extended to cover a larger area. With the conductive pattern of G13 being nearly identical to that of G12, the pattern is de-squinted by the same amount as it is squinted. Thus the amplitude distribution of the original feed pattern, only modified by the collimating grid G11, is replicated in the plane of G13. However the phase distribution is significantly altered such that the phase center is transposed from a distance of X2 from the antenna axis, to a distance of X1 from the antenna axis. This facilitates the ability to achieve small beam separation angles of secondary radiation patterns that are not otherwise possible.

Figure 1J:
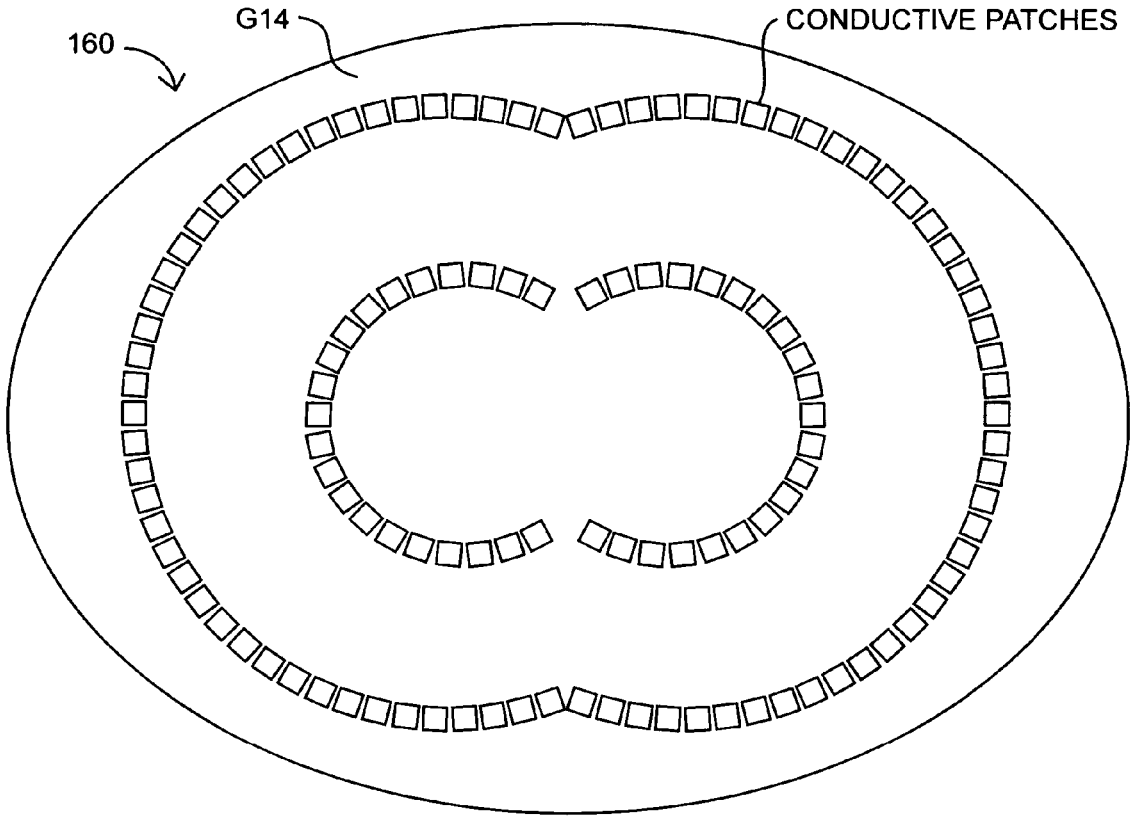
FIG. 1J shows an example embodiment of a sectoring grid layer that can be used in the transmissive differential phase and amplitude compensating structure of FIG. 1A.

FIG. 1J shows an example embodiment of a sectoring array layer 160 (G14) configured with conductive patches as shown to transform the cos(x) phase and amplitude distribution from the feed into a sin(x)/(x) phase and amplitude distribution at the plane of G14. The conductor density is set to provide a near 180 degree transmission phase delay in several narrow concentric rings surrounding the beam peak of the squinted/de-squinted feed pattern after passing through array layers G11, G12 and G13. It is not necessary to have complete circular symmetry in this layer. The azimuth and elevation plane dimensions of the concentric rings can be different from each other to produce sector radiation patterns with different azimuth and elevation plane primary beamwidths.

In combination, the four array layers G11, G12, G13 and G14 transform a cos(x−x2) distribution at the feed aperture to a sin(x−x1)/(x−x1) distribution at the outer surface of the compensating structure 106, where x1 and x2 are shown in FIG. 1B. The resulting primary radiation pattern illuminates the surface of the reflector with a spherical wave that appears to emanate from a point that has been transposed from position x1 to position x2, with near uniform amplitude distribution and a rapid roll off near the edges of the reflector.

Other types of patches, loops, strips, slots or apertures can be utilized in the grids. Likewise their function can be combined with that of the dielectric to increase bandwidth of the system. Many different phase and amplitude distributions can be realized through the compensating structures described herein.

Various embodiments are directed to multi beam, multi band reflector antenna systems where the beam pointing angles are very small for the relative size of the antenna or the geometry of the antenna requires the feeds to be positioned in locations that would produce undesirable beam pointing angles and where high efficiency and significant off bore-sight rejection are required. An example embodiment of an antenna system includes a reflector, a multiplicity of feeds, and a compensating structure disposed between the feeds and the reflector. By way of example, the compensating structure includes multiple layers of non-uniform arrays of conductive patches. The dimensions of the patches are less than a quarter wavelength across. The layers are paired up and separated a distance such that each pair produces a very small reflection coefficient. The spacing of a related pair of layers is a quarter of the effective wavelength. Unrelated pairs are spaced much greater than a quarter wavelength, and are not affected by mutual coupling. Each layer performs different functions or can have several functions combined in a given layer. The functions of the individual layers include collimating, squinting, de-squinting, sectoring and compensating of the feed primary radiation pattern. The squinting and de-squinting array layers are used to re-locate the phase center position, x2, from one or more of the feeds to a location, x1, that is laterally displaced from its original position, while maintaining the illumination efficiency of the reflector. The collimating and sectoring arrays are used to transform a cos(x) distribution at the feed aperture to a sin(x)/(x) distribution at the outer surface of the compensating structure. Combining all of the above functions, the primary radiation pattern is transformed from a cos(x−x1) distribution at the feed aperture to a sin(x−x2)/(x−x2) distribution at the outer surface of the compensating structure. The resulting primary radiation pattern illuminates the surface of the reflector with a spherical wave emanating from a point that has been transposed from position x1 to position x2, with near uniform amplitude distribution and a rapid roll off near the edges of the reflector. This produces a substantial increase in antenna efficiency while maintaining low side lobe levels on the secondary radiation pattern.

In the transmissive compensating structure, it has been observed that a useful range of phase shift is achieved simultaneously with very low reflection coefficient by using two identical layers of arrays with appropriate spacing. The arrays are non-uniform across the surface to provide a phase shift variation as a function of position. Depending on the amount of phase shift provided at each position, the separation between the two layers is set at that location specifically to achieve a low reflection coefficient. In addition to the element spacing or element dimensions not being uniform, the layer separation is not uniform. Thus, the relationship that phase shift is proportional to reflection coefficient is eliminated.

Making use of this principle, specific layer pairs can be configured to provide the functions of collimating, squinting, de-squinting, and sectoring the radiation pattern from the feed horn. Use of the layers described herein with a small reflector (on the order of 60 cm) and several feeds provides a multi-beam, multi-band antenna that has higher efficiency than is possible with prior systems, and beams pointing in directions not possible with reflectors of this small size. Consequently, the principles described herein allow smaller antennas to receive signals from geosynchronous satellites spaced 2 degrees apart than was previously possible utilizing prior approaches. By way of example, the principles described herein can be used for such purposes while operating at frequencies ranging from 10 GHz up to 30 GHz.

In an example embodiment, a compensating structure includes layers of non-uniform arrays of conductive patches configured to provide phase and/or amplitude distribution modification of feed primary patterns.

In an example embodiment, a compensating structure includes layers of conductive elements that function as lossless lenses, with specific behavior over different frequency bands.

In an example embodiment, an apparatus for modifying a feed pattern includes a compensating structure including layers of conductive patch arrays that are non-uniform and configured to provide a phase shift variation as a function of position.

In an example embodiment, an antenna system includes a reflector, feeds, and a compensating structure including multiple layers of non-uniform arrays of conductive patches configured to modify a feed radiation pattern according to one or more functions associated with the layers.

Figure 2A:
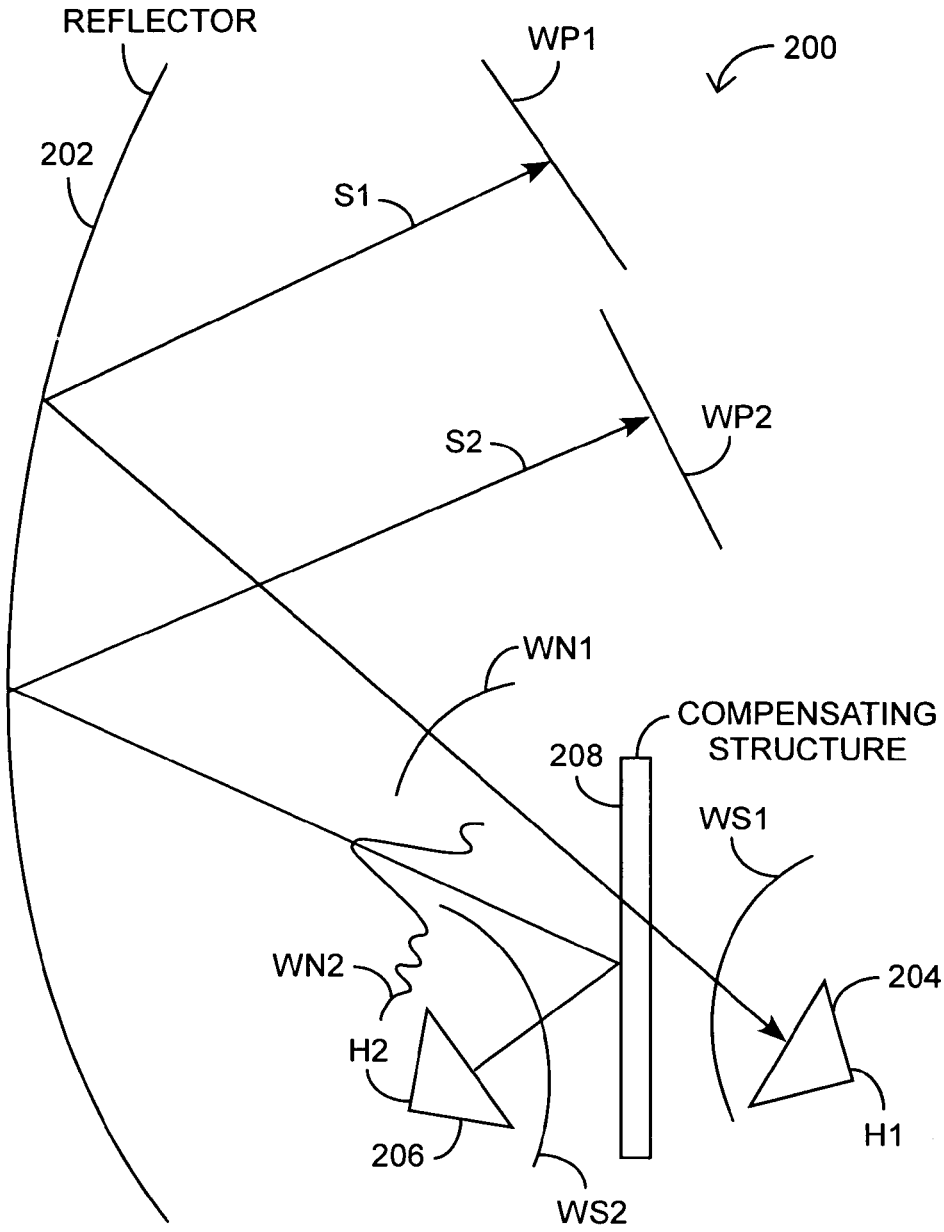
FIG. 2A illustrates a reflective and transmissive differential phase and amplitude compensating dual frequency antenna system according to an example embodiment of the present invention.

Referring to FIG. 2A, in another example embodiment, a reflective and transmissive differential phase and amplitude compensating dual frequency antenna system 200 includes a reflector 202, feeds 204 (H1) and 206 (H2), and a compensating structure 208 configured as shown. The system 200 is a multi-beam, multi-band antenna system. In this example embodiment, the compensating structure 208 allows for retrofitting of the second feed horn, H2, to provide an additional signal, S2, to an existing antenna system. The feed horn, H2, is positioned in a more convenient location other than the image focal point, such as a location that does not produce any geometric optics blockage from the reflector aperture or the path between the feed horn, H1, and the reflector 202. This allows for the potential of retrofitting to existing antenna designs without the resulting blockage and subsequent performance degradation.

The compensating structure 208 is configured such that its presence does not alter the signal, S1, from horn H1. However the compensating structure 208 is configured to modify the phase and amplitude of the signal, S2, from horn H2 in such a way that eliminates the phase errors associated with the arbitrary positioning of the horn H2, and modifies the amplitude distribution such that the efficiency of the signal S2 is improved relative to that of S1.

In this example embodiment, the signal S1 is incident on the antenna system 200 with the far field planar wave front, WP1. It is then reflected towards horn H1 with a non-linear phase front WN1, and passes through the compensating surface 208 such that the wave front WS1 is identical to WN1.

The signal, S2, is also incident on the antenna system 200 from some arbitrary angle with the far field planar wave front, WP2. It is then reflected towards the compensating structure 208, where it is further reflected into horn H2. The reflection is not characteristic of a flat surface and the compensating structure 208 transposes the non linear wave front WN2 into the spherical wave front WS2 and couples to horn H2 with high efficiency.

Figure 2B:
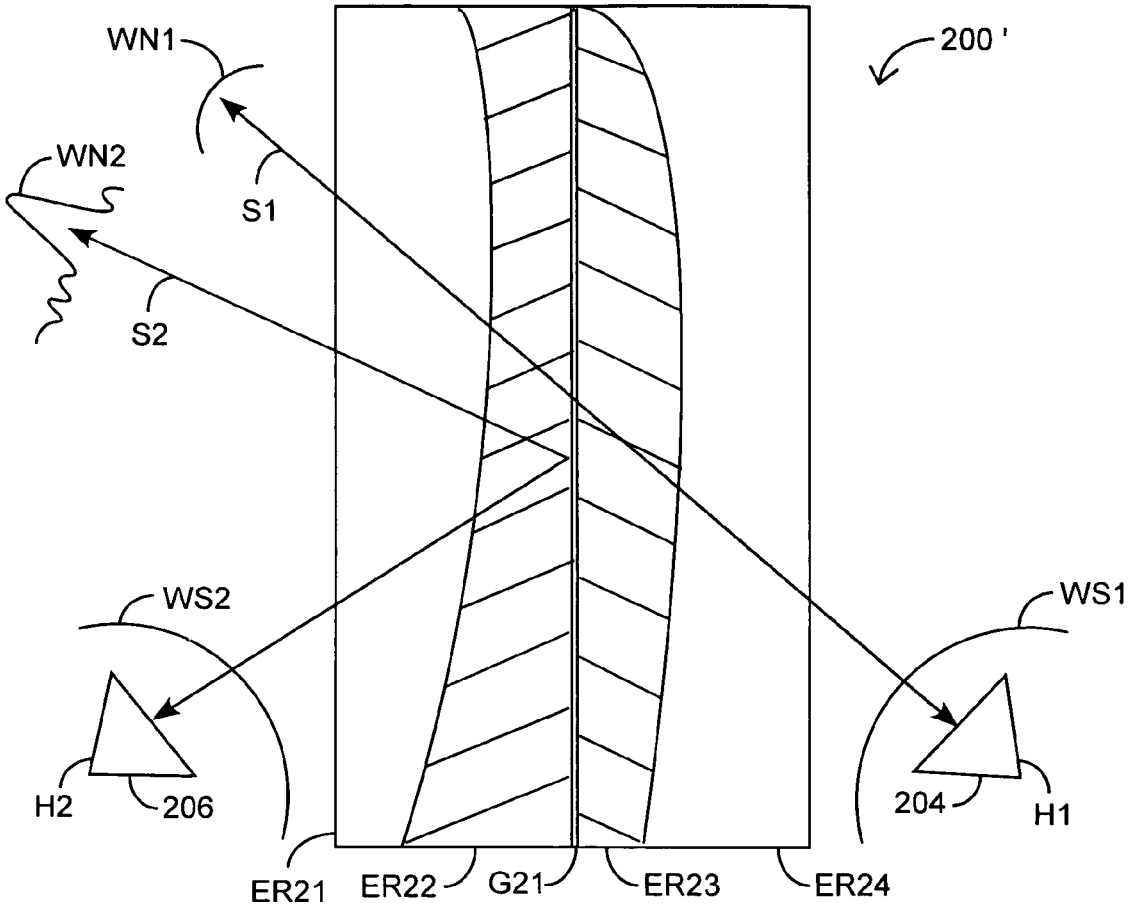
FIG. 2B is a cross-sectional view of an example reflective and transmissive differential phase and amplitude compensating structure with discrete dielectric constant variation.
Figure 2C:
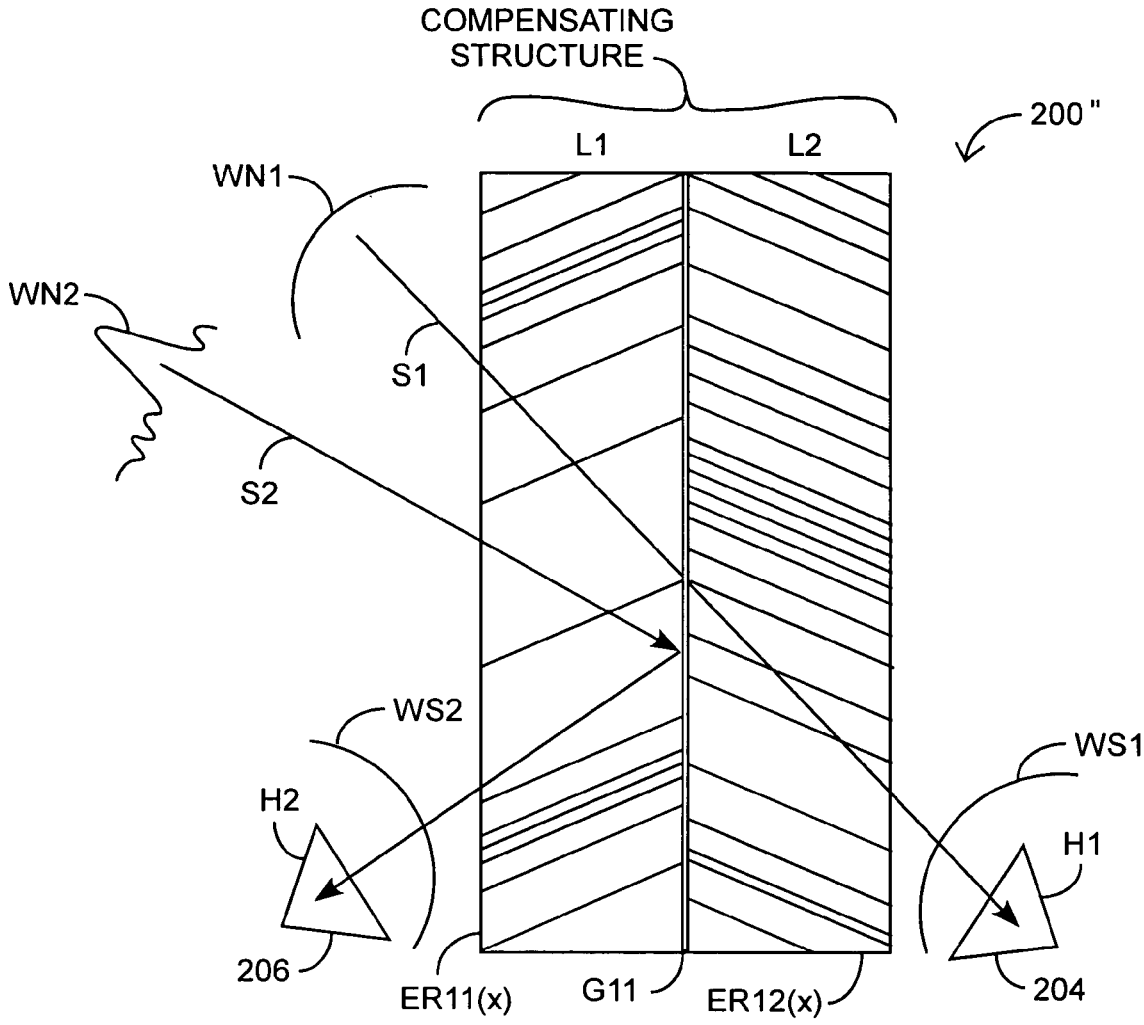
FIG. 2C is a cross-sectional view of an example reflective and transmissive differential phase and amplitude compensating structure with continuous dielectric constant variation.

FIGS. 2B and 2C illustrate examples of compensating structures suitable for use with the antenna system 200. FIG. 2B shows an example reflective and transmissive differential phase and amplitude compensating structure 200' with discrete dielectric constant variation. FIG. 2C shows an example reflective and transmissive differential phase and amplitude compensating structure 200" with continuous dielectric constant variation. In FIG. 2B, the dielectric constant variation is discrete, and denoted by values ER11, ER12, ER13 and ER14. In FIG. 2C, the dielectric constant variation is continuous and a function of location ER11(X) and ER12(X), where X is the location on the surface of structure.

The grid G11, in this example embodiment, is a frequency selective surface with only one layer shown. It should be understood, however, that multiple grid layers can be used, with the resulting bandwidth being directly proportional to the number of grid layers. G11 is configured as shown such that it is reflective at the frequency of S2 and transparent at the frequency of S1.

The propagation delay from the surface of ER11(X) to the grid G11 and back to the surface of ER 11(X) along the path S2 is a function of X. However ER12(X) can be varied such that the propagation delay of S1 through both dielectric layers is constant for all values of X. This can be accomplished by providing a propagation delay from the surface of ER12(X) to the grid G11 that compensates for the propagation delay from the grid G11 to the surface of ER11(X) along the path of signal S1. Accordingly, this provides for independent control of the propagation delay of both S1 and S2.

When the dielectric layers are thin, it is not possible to control the amplitude distribution of the signal. However, independent amplitude control of S1 and S2 can be obtained by adding additional layers to the structure or by making ER11(X) and ER12(X) thick relative to the wavelengths of signals S1 and S2.

The required value of ER12(X) is found from $$ER12(X) = \left[ l_2 \Big/ \left( \frac{LS1\lambda_1}{2\pi} - \frac{l_1}{\sqrt{ER11(X)}} \right) \right]^2$$

Where $l_1$ and $l_2$ is the thickness of ER11(X) and ER12(X) respectively.

Alternatively it is also possible to perform the same function by replacing the dielectric layers with grids of phase shifting elements or a combination of grids and dielectric layers that vary as a function of X on both sides of the frequency selective surface G1, modifying the signal S2 and then compensating the signal S1 independently of S2.

In an example embodiment, an antenna system includes a satellite installation, and a mechanism for retrofitting additional bands and additional beams to the satellite installation without introducing degradations resulting from aperture blockage. By way of example, the satellite installation can be a Direct Broadcast Satellite (DBS) installation or a Very Small Aperture Terminal (VSAT) installation. By way of example, the mechanism for retrofitting includes a compensating structure positioned between a reflector and a feed of the DBS installation. In various embodiments, the compensating structure includes layers of non-uniform arrays of conductive patches configured to modify a feed radiation pattern according to one or more functions associated with the layers. In various embodiments, the compensating structure includes a frequency selective surface and a material that provides dielectric constant variation across the compensating structure.

Figure 3A:
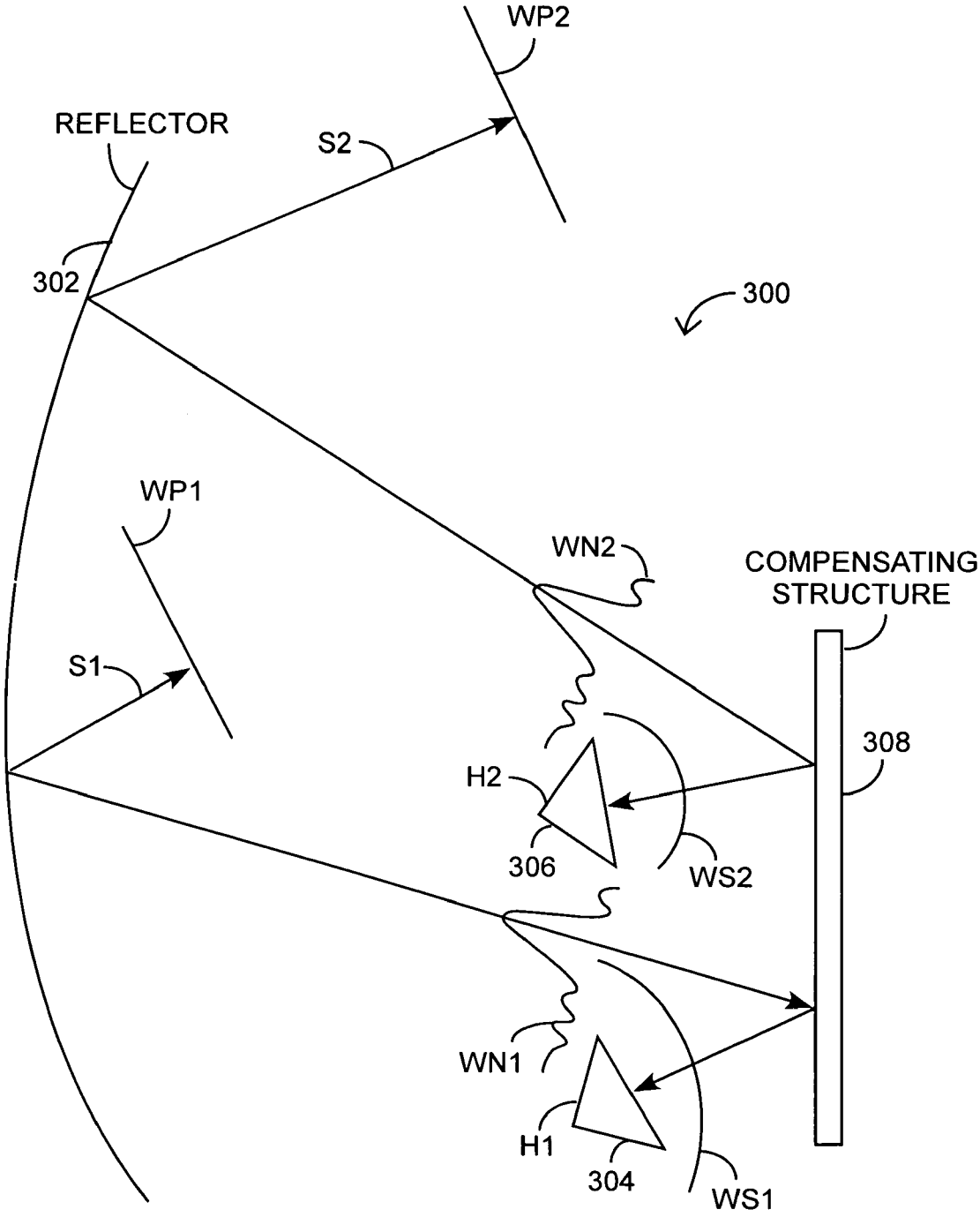
FIG. 3A illustrates a reflective differential phase compensating dual frequency antenna system according to an example embodiment of the present invention.
Figure 3B:
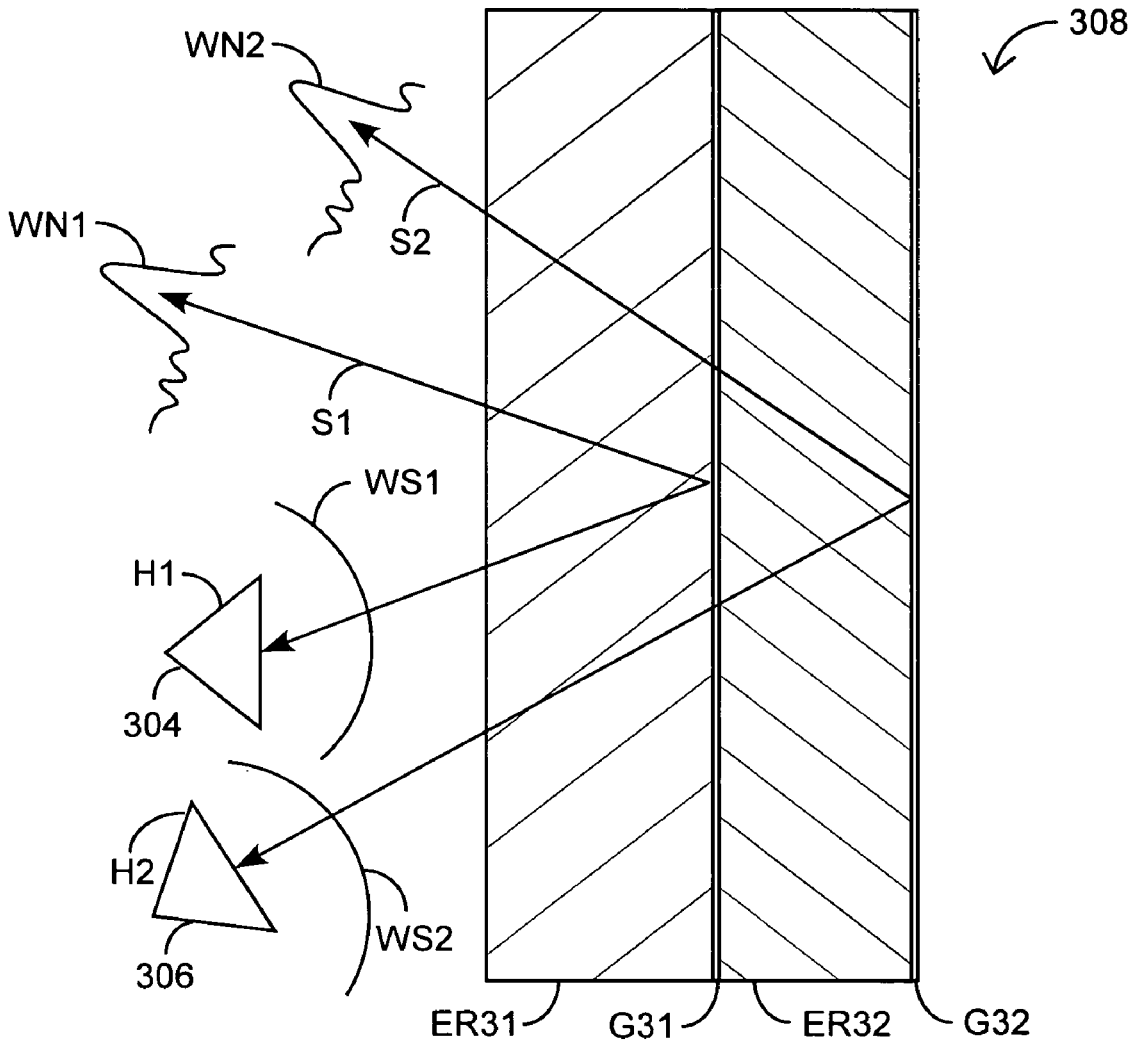
FIG. 3B is a cross-sectional view of the reflective differential phase compensating structure of FIG. 3A.

Referring to FIG. 3A, in another example embodiment, a reflective differential phase compensating dual frequency antenna system 300 includes a reflector 302, feeds 304 (H1) and 306 (H2), and a compensating structure 308 configured as shown. Referring to FIG. 3B, in this example embodiment, the compensating structure 308 includes grid G32 (e.g., a solid conductive surface), grid G31 (e.g., a grid of varying slots or patches), and dielectric slabs ER31 and ER32 (e.g., axially or transversely varying dielectric slabs) configured as shown.

Figure 4A:
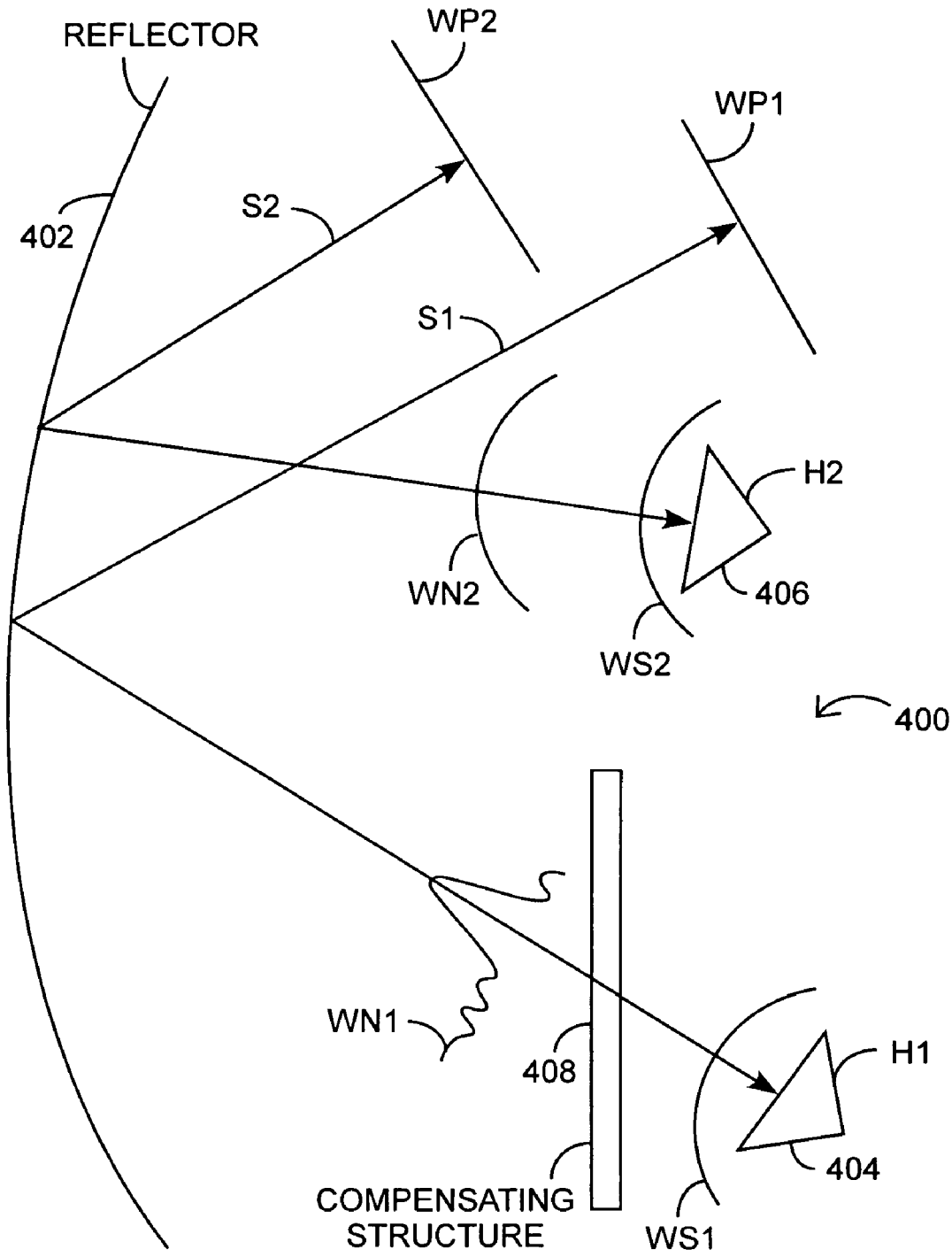
FIG. 4A illustrates a transmissive differential amplitude compensating antenna system according to an example embodiment of the present invention.
Figure 4B:
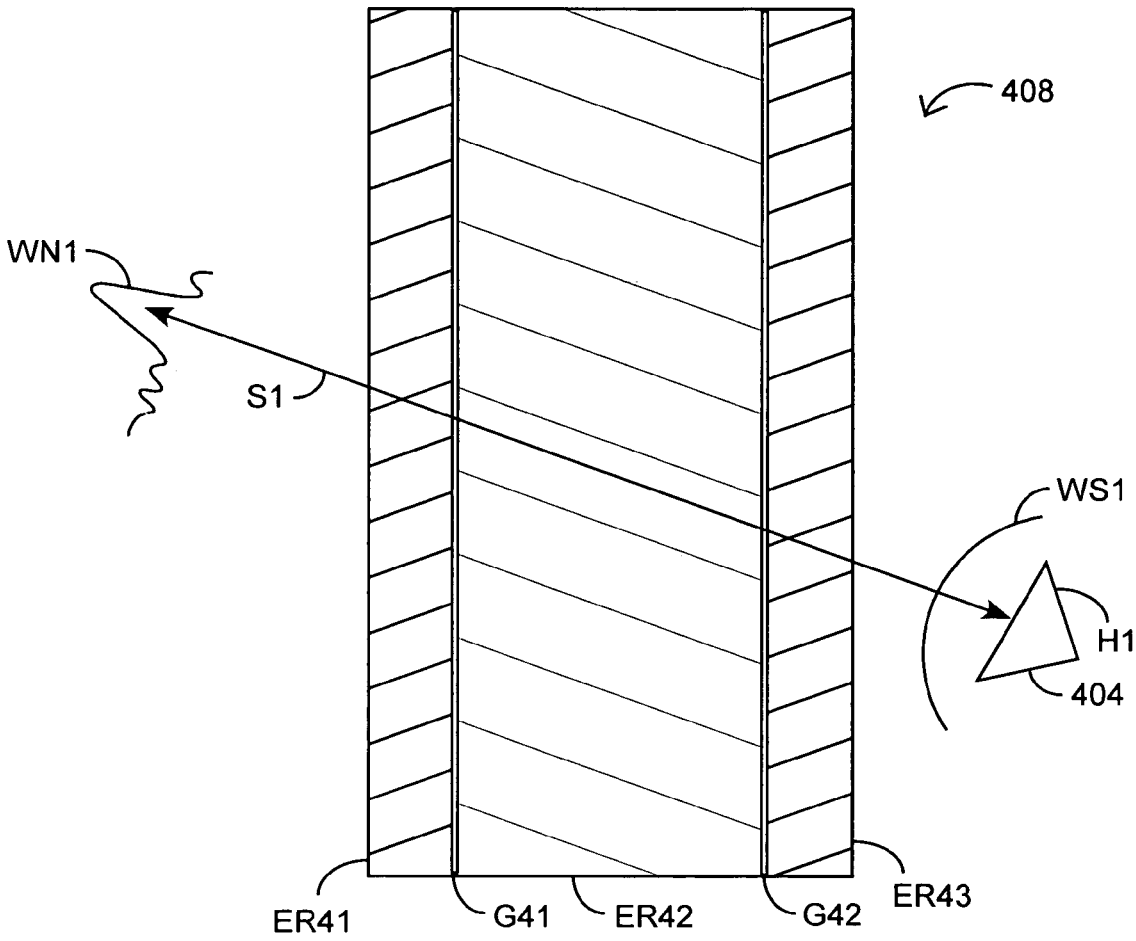
FIG. 4B is a cross-sectional view of the transmissive differential amplitude compensating structure of FIG. 4A.

Referring to FIG. 4A, in another example embodiment, a transmissive differential amplitude compensating antenna system 400 includes a reflector 402, feeds 404 (H1) and 406 (H2), and a compensating structure 408 configured as shown. The principles described with reference to FIGS. 1A–1C can be used to provide the amplitude compensating functionality of the structure 408 for a transmissive system.

Although the present invention has been described in terms of the example embodiments above, numerous modifications and/or additions to the above-described embodiments would be readily apparent to one skilled in the art. It is intended that the scope of the present invention extends to all such modifications and/or additions.

I claim:

1. A compensating structure comprising:

layers of non-uniform arrays of conductive patches configured to provide phase and/or amplitude distribution modification of feed primary patterns; and one or more dielectric layers between the layers of non-uniform arrays of conductive patches.

2. The compensating structure of claim 1, wherein the non-uniform arrays of conductive patches provide a differential phase delay proportional to a conductor density.

3. The compensating structure of claim 1, wherein the non-uniform arrays of conductive patches are arranged in layer pairs to minimize a reflection coefficient of the layer pairs.

4. The compensating structure of claim 3, wherein the layers are separated by spacing inversely proportional to a conductor density.

5. The compensating structure of claim 1, wherein the compensating structure is configured to collimate a primary radiation pattern.

6. The compensating structure of claim 1, wherein the compensating structure is configured to squint a primary radiation pattern.

7. The compensating structure of claim 1, wherein the compensating structure is configured to de-squint a primary radiation pattern.

8. The compensating structure of claim 1, wherein the compensating structure is configured to sector a primary radiation pattern.

9. The compensating structure of claim 1, wherein the compensating structure functions as a lossless lens.

10. A compensating structure comprising:

layers of conductive elements that function as lossless lenses, with specific behavior over different frequency bands;

wherein the layers include a sectoring array layer configured to transform a cos(x) phase and amplitude distribution from a feed into a sin(x)/(x) phase and amplitude distribution.

11. The compensating structure of claim 10, wherein the layers are configured to collimate a primary feed radiation pattern.

12. The compensating structure of claim 10, wherein the layers are configured to squint a primary feed radiation pattern.

13. The compensating structure of claim 10, wherein the layers are configured to de-squint a primary feed radiation pattern.

14. The compensating structure of claim 10, wherein the layers are configured to sector a primary feed radiation pattern.

15. The compensating structure of claim 10, wherein the layers are configured to align a radiation pattern with a feed axis of the radiation pattern and to transpose a phase center of the radiation pattern off the feed axis.

16. The compensating structure of claim 10, wherein separations between the layers are inversely proportional to a conductor density.

17. The compensating structure of claim 10, wherein the layers include a collimating array layer configured to provide a collimating lens effect for multiple separate feeds.

18. The compensating structure of claim 17, wherein the collimating array layer has a conductor density that is greatest at a center of a feed axis and decreases radially outward from the feed axis.

19. The compensating structure of claim 17, wherein the collimating array layer is configured to transform a concave spherical phase front to a planar or convex phase front at a near field region adjacent to the feeds.

20. The compensating structure of claim 10, wherein the layers include a squinting array layer configured to squint a beam from a feed in one direction.

21. The compensating structure of claim 20, wherein a density of the squinting array layer varies such that a phase progression is achieved across an aperture of the feed.

22. The compensating structure of claim 10, wherein the layers include a de-squinting array layer configured to alter a phase distribution of a feed pattern.

23. The compensating structure of claim 22, wherein the de-squinting array layer is configured to transpose a phase center of the feed pattern.

24. The compensating structure of claim 10, wherein the sectoring array layer has a conductor density that provides a phase delay in a plurality of concentric rings.

25. An apparatus for modifying a feed pattern comprising:

a compensating structure including layers of conductive patch arrays that are non-uniform and configured to provide a phase shift variation as a function of positions;

wherein the layers include layer pairs configured to provide the functions of collimating, squinting, de-squinting, and sectoring a radiation pattern.

26. The apparatus for modifying a feed pattern of claim 25, wherein a separation between the layers is set depending upon an amount of phase shift provided at each position to provide a low reflection coefficient.

27. The apparatus for modifying a feed pattern of claim 25, wherein the compensating structure is configured to operate at frequencies ranging from 10 GHz up to 30 GHz.

28. An antenna system comprising a reflector;

feeds; and a compensating structure including multiple layers of non-uniform arrays of conductive patches configured to modify a feed radiation pattern according to one or more functions associated with the layers.

29. The antenna system of claim 28, wherein the functions include a collimating function.

30. The antenna system of claim 28, wherein the functions include a squinting function.

31. The antenna system of claim 28, wherein the functions include a de-squinting function.

32. The antenna system of claim 28, wherein the functions include a sectoring function.

33. The antenna system of claim 28, wherein dimensions of the conductive patches are approximately less than a quarter wavelength across.

34. The antenna system of claim 28, wherein the layers are paired up and separated a distance such that each pair produces a very small reflection coefficient.

35. The antenna system of claim 28, wherein the layers included a related pair of layers which are spaced apart by approximately a quarter of the effective wavelength.

36. The antenna system of claim 28, wherein the layers include unrelated pairs of layers which are spaced apart by more than a quarter wavelength and not affected by mutual coupling.

37. The antenna system of claim 28, wherein the layers include squinting and de-squinting array layers configured to re-locate a phase center position from one or more of the feeds to a location that is laterally displaced from an original phase center position, while maintaining an illumination efficiency of the reflector.

38. The antenna system of claim 28, wherein the layers include collimating and sectoring array layers configured to transform a cos(x) distribution at a feed aperture to a sin(x)/(x) distribution at an outer surface of the compensating structure.

39. The antenna system of claim 28, wherein the layers are configured to transform a primary radiation pattern from a cos(x−x1) distribution at a feed aperture to a sin(x−x2)/(x−x2) distribution at an outer surface of the compensating structure.

40. The antenna system of claim 28, wherein the layers are configured to transform a cos(x−x2) distribution at a feed aperture to a sin(x−x1)/(x−x1) distribution at an outer surface of the compensating structure.

41. The antenna system of claim 28, wherein the layers are configured to generate a resulting primary radiation pattern that illuminates a surface of the reflector with a spherical wave emanating from a point that has been transposed, with near uniform amplitude distribution and a rapid roll off near edges of the reflector.

42. The antenna system of claim 28, further comprising:

a low dielectric constant material separating layers of a layer pair.

43. The antenna system of claim 42, wherein the layer pair are separated a distance that is a quarter of the effective wavelength or less, such that the layer pair produces a very small reflection coefficient.

44. The antenna system of claim 42, wherein the low dielectric constant material is Polystyrene foam or Polyimide foam.

45. An antenna system comprising a satellite installation; and means for retrofitting additional bands and additional beams to the satellite installation without introducing degradations resulting from aperture blockage.

46. The antenna system of claim 45, wherein the satellite installation is a Direct Broadcast Satellite (DBS) installation.

47. The antenna system of claim 45, wherein the satellite installation is a Very Small Aperture Terminal (VSAT) installation.

48. The antenna system of claim 45, wherein the means for retrofitting includes a compensating structure positioned between a reflector and a feed of the DBS installation.

49. The antenna system of claim 48, wherein the compensating structure includes layers of non-uniform arrays of conductive patches configured to modify a feed radiation pattern according to one or more functions associated with the layers.

50. The antenna system of claim 49, wherein the functions include a collimating function.

51. The antenna system of claim 49, wherein the functions include a squinting function.

52. The antenna system of claim 49, wherein the functions include a de-squinting function.

53. The antenna system of claim 49, wherein the functions include a sectoring function.

54. The antenna system of claim 48, wherein the compensating structure includes a frequency selective surface and a material that provides a dielectric constant variation across the compensating structure.

55. The antenna system of claim 54, wherein the dielectric constant variation is discrete.

56. The antenna system of claim 54, wherein the dielectric constant variation is continuous.

* * * * *